US006325319B1

(12) United States Patent
Noji

(10) Patent No.: US 6,325,319 B1
(45) Date of Patent: Dec. 4, 2001

(54) WINDING APPARATUS FOR EASING THE BEND OF LINE MATERIAL

(75) Inventor: Kaoru Noji, Date-gun (JP)

(73) Assignee: Nittoku Engineering Co., Ltd. (JP)

( * ) Notice: Subject to any disclaimer, the term of this patent is extended or adjusted under 35 U.S.C. 154(b) by 0 days.

(21) Appl. No.: 09/181,563

(22) Filed: Oct. 29, 1998

(30) Foreign Application Priority Data

Nov. 28, 1997 (JP) ..... 9-329265

(51) Int. Cl.[7] ..... B21C 47/14
(52) U.S. Cl. ..... 242/439.1
(58) Field of Search ..... 242/439.1, 439.2, 242/437.2, 157 R; 29/599, 605

(56) References Cited

U.S. PATENT DOCUMENTS

| | | | | |
|---|---|---|---|---|
| 3,244,202 | | 4/1966 | Huang . | |
| 3,619,829 | | 11/1971 | Finn et al. . | |
| 3,967,661 | | 7/1976 | Scoville et al. . | |
| 4,076,056 | * | 2/1978 | Dummel | 242/439.1 |
| 4,195,400 | * | 4/1980 | Sprenkle | 242/439.1 X |
| 4,287,666 | * | 9/1981 | Sprenkle | 242/439.1 X |
| 4,407,337 | * | 10/1983 | Hines et al. | 242/439.1 |
| 4,467,842 | * | 8/1984 | Galloup et al. | 242/439.1 X |

FOREIGN PATENT DOCUMENTS

| | | | | |
|---|---|---|---|---|
| 23 43 847 | | 12/1974 | (DE) . | |
| 24 34 573 | | 1/1976 | (DE) . | |
| 247 313 A1 | | 7/1987 | (DE) . | |
| 196 38 250 C1 | | 2/1998 | (DE) . | |
| 1 515 317 | | 6/1978 | (GB) . | |
| 2090172 | * | 7/1982 | (GB) | 242/439.2 |
| 2-122611 | | 5/1990 | (JP) . | |
| 6-231988 | | 8/1994 | (JP) . | |
| 1003404 | * | 3/1983 | (RU) | 242/439.1 |
| 1001203 | * | 2/1983 | (RU) | 242/439.2 |

* cited by examiner

*Primary Examiner*—Donald P. Walsh
*Assistant Examiner*—William A. Rivera

(57) ABSTRACT

A winding apparatus, which delivers a line material from a nozzle and winds said line material, providing a notch portion on the tip portion of said nozzle, which eases the amount of bending of said line material.

7 Claims, 2 Drawing Sheets

WINDING APPARATUS FOR EASING THE BEND OF LINE MATERIAL

BACKGROUND OF THE INVENTION

1. Technical Field of the Invention

The present invention relates to a winding apparatus. More particularly, it relates to an art of delivering a line material.

2. Description of the Related Art

With respect to a winding apparatus when winding a line material onto a bobbin or such, the line material supplied from the line material supplying means is delivered from the tip portion of a tubular nozzle and is wound around the bobbin. In such a case, the larger the bending angle (the bending rate) of the line material at the tip portion of the nozzle, the larger the frictional force from the sliding action of the line material against the tip portion of the nozzle, thereby increasing the tension of the line material.

In such winding apparatuses which delivers the line material from the nozzle and winds that line material, a relatively large force is acting on the nozzle (especially, the tip portion of the nozzle). This causes such problems as the deformation of the nozzle or the bending of the terminal of the bobbin due to the tension of the line material when winding the line material onto the terminal. In response to such inconveniences, conventionally, measures were taken such as to thicken the width of the nozzle in order to increase the rigidity of the nozzle or to employ a mechanism which will forcibly deliver the line material from the nozzle in order to lessen the force acting on the nozzle.

However, for example, in the case where the width of the nozzle is thickened as in the conventional art, the nozzle becomes very large. This causes such problems as the contacting of the nozzle with an adjacent terminal when winding up the line material or the contacting of the nozzle with the bobbin when the line material slides along the groove in the bobbin. On the other hand, in the case where a mechanism is employed to forcibly deliver the line material from the nozzle, the tension of the line material slackens, thereby, causing the problem of not being able to tightly wind the line material on to the terminal.

SUMMARY OF THE INVENTION

The present invention, hence, takes the above-mentioned circumstances into consideration, and proposes to offer the following objectives:

a. to prevent the increase in the tension of the line material at the tip portion of the nozzle;

b. to wind the line material without enlarging the nozzle;

c. to wind the line material without forcibly delivering the line material from the nozzle;

d. to prevent damage of the nozzle and the terminal during the winding process; and e. to tightly wind the line material on to the terminal.

In order to achieve the above listed objectives, the present invention, with respect to a winding apparatus which delivers a line material from a nozzle and winds that line material, employs a means for providing a notch portion which eases the amount of bending of the line material at the tip portion of the nozzle. By employing such structure, it is possible to prevent the increase in the tension of the line material due to the sliding action against the nozzle. Consequently, it is possible to wind the line material without enlarging the nozzle or without employing a mechanism which forcibly delivers the line material from the nozzle, as in the conventional means. And it is possible to prevent the damaging of the nozzle and the terminal during the winding process.

In addition, with respect to a winding apparatus which delivers a line material from a nozzle and winds that line material, the present invention comprises a terminal winding means for inserting a terminal into a guide hole and for revolving the nozzle around the periphery of the terminal with the guide hole as its center of rotation, for the winding process of the line material around the terminal of the bobbin. By this means, the damage of the terminal can be effectively prevented.

DETAILED DESCRIPTION OF THE PREFERRED EMBODIMENTS OF THE INVENTION

A preferred embodiment of the present invention will be explained below, with reference to drawings.

Figure 1:
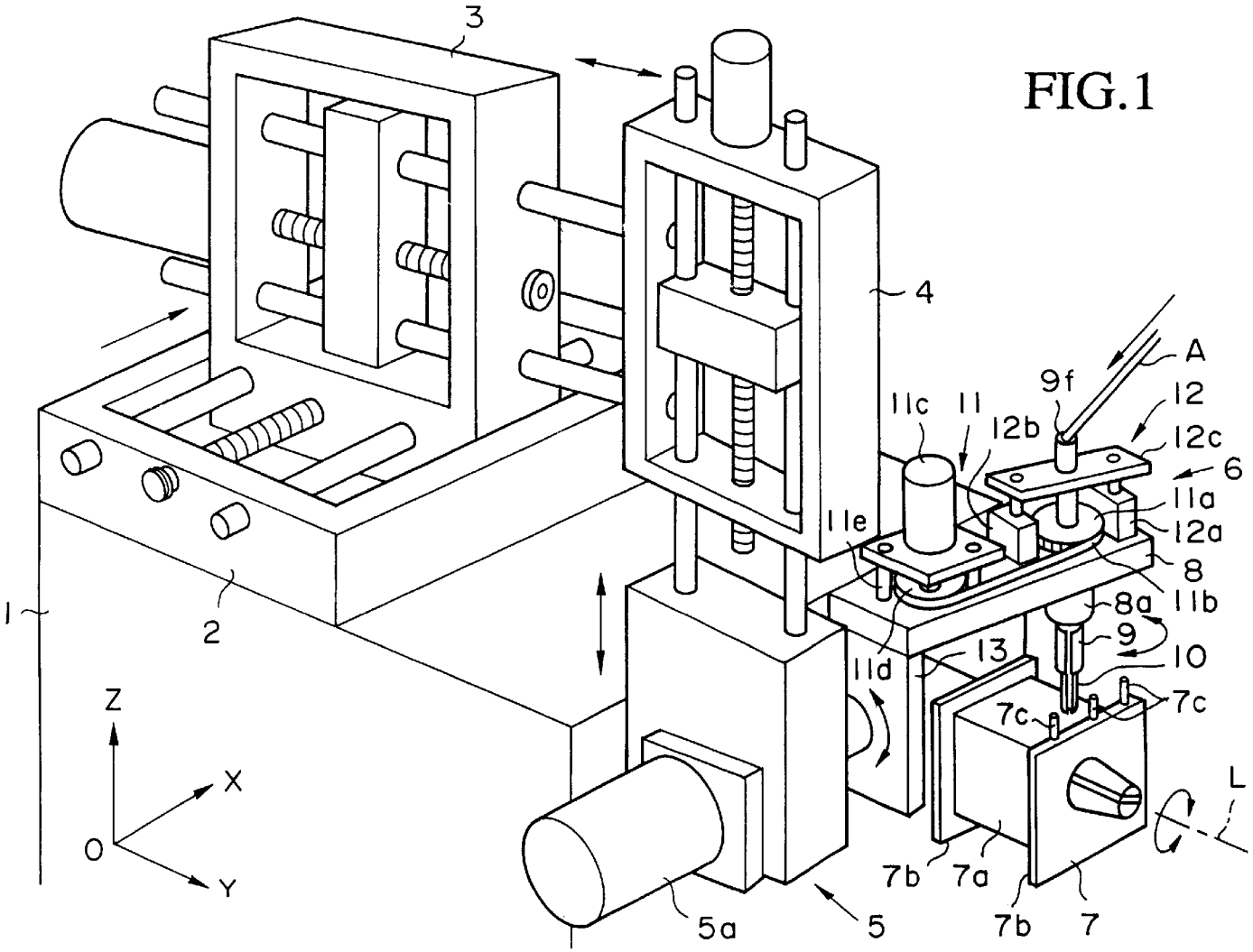
FIG. 1 is a perspective diagram illustrating the structure of a preferred embodiment of the present invention.

FIG. 1 is a perspective diagram illustrating the fundamental structure of the present embodiment. In this diagram, reference numeral 1 is the base, and a x-axis moving portion 2 is provided on this base 1. This x-axis moving portion 2 moves the y-axis moving portion 3 in the x-axis direction on top of the base 1 by employing a ball-thread mechanism. The y-axis moving portion 3 moves the z-axis moving portion 4 in the y-axis direction by also employing a ball-thread mechanism. The z-axis moving portion 4 moves the inclined moving portion 5 in the z-axis direction by also employing a ball-thread mechanism. The inclined moving portion 5 tilts the nozzle mechanism 6 inside the y-z plane (vertical plane) by the rotation of the motor 5*a*.

In addition, reference numeral 7 is the tubular bobbin which is mounted on a spindle head (not shown in diagram) which is fixed to the base 1. For example, this bobbin 7 is a transformer-specific bobbin, and has a plurality of pole-shaped terminals 7*c* implanted on either one of the two flanges 7*b*, 7*b* which are provided on both ends of the tube-shaped winding portion 7*a*. By having the above spindle head be rotatably-driven by means of a spindle motor provided on the base 1, the bobbin 7 is made so as to have the winding portion 7*a* rotate inside the x-z plane with the L-axis as its center of rotation. Here, the bobbin 7 can be easily placed on and removed from the spindle head due to a piece which is not shown in the diagram.

Next, the detailed structure of the above nozzle mechanism 6 will be explained with reference to FIGS. 1, 2A and 2B.

This nozzle mechanism 6 is formed by a nozzle guide 9 which is rotatably supported to a plate 8 via a hollow cylindrical supporting piece 8*a*, a nozzle 10 which is disposed inside the nozzle guide 9 by insertion, a nozzle rotating mechanism 11 which rotatably drives the nozzle 10 along with the nozzle guide 9, a nozzle guide moving mechanism 12 which moves the nozzle guide 9 along the axis relative to the nozzle 10, and a blanket 13 which attaches the plate 8 on to the axle of the motor 5*a*. The nozzle guide 9, the nozzle rotating mechanism 11, and the nozzle guide moving mechanism 12 form the terminal winding means.

Figure 2A:
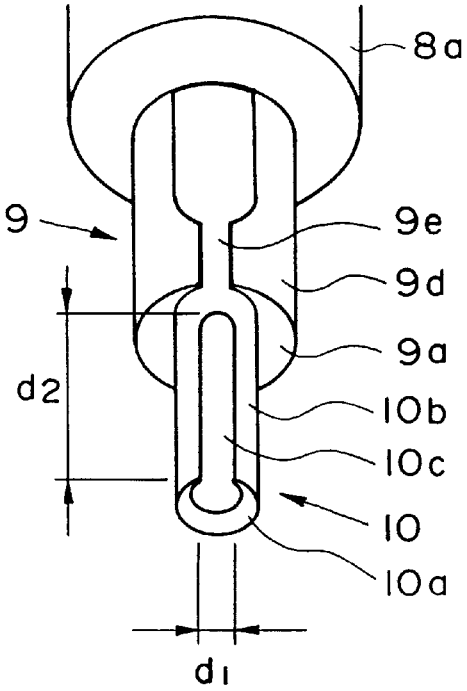
FIG. 2A is a first perspective diagram illustrating the detailed structure of a nozzle according to a preferred embodiment of the present invention.
Figure 2B:
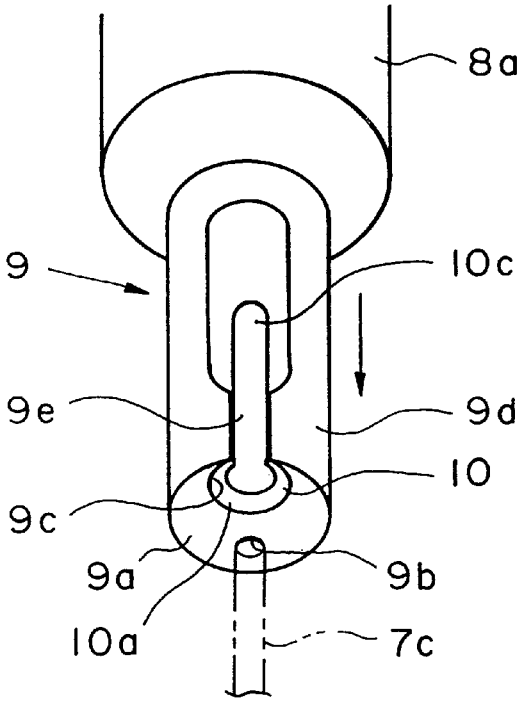
FIG. 2B is a second perspective diagram illustrating the detailed structure of a nozzle according to a preferred embodiment of the present invention.

As illustrated in FIGS. 2A and 2B, the above mentioned nozzle guide 9 has a tubular shape. A guide hole 9*b* in which the above mentioned pole-shaped terminal 7*c* is inserted and an eccentric hole 9*c* in which the nozzle 10 is inserted are formed on the tip surface 9*a* of the nozzle guide 9. A notch portion 9*e* which extends to the eccentric hole 9*c* is formed on the side surface 9*d* of the nozzle guide 9. In addition, a notch portion 10*c* which extends from the tip portion 10*a* along the side surface 10*b* and which has a fixed width d1 and a fixed length d2 is formed in the position corresponding to the above mentioned notch portion 9*e* on the tip portion of the tube-shaped nozzle 10 which is to be inserted in the eccentric hole 9*c*.

The width d1 of the above mentioned notch portion 10*c* is set to be slightly wider than the thickness of the line material A which is to be wound around the bobbin 7. The length d2 of the notch portion 10*c* suitably set according to the thickness and the rigidity of the line material A, that is, the type of line material A. With respect to the notch portion 9*e* of the nozzle guide 9, that is formed to have a width that is almost identical as that of the above mentioned notch portion 10*c*, but its length is set to be longer than the notch portion 10*c*. In addition, as illustrated in FIG. 2B, these notch portions 9*e*, 10*c* are formed so as to be positioned on the opposite of the guide hole 9*b*.

Furthermore, with respect to the above mentioned nozzle guide 9, its center is rotatably supported by the above mentioned plate 8 via the bearings (not shown in diagram), and a line insertion opening 9*f* which connects through to the tube-shaped nozzle 10 which is inserted in the eccentric hole 9*c* is formed in the tail portion. The line material A is supplied by a line material supplying means (not shown in diagram) and is inserted into the line material insertion opening 9*f*. And, the line material A which is inserted into the line material insertion opening 9*f* is pulled out from the tip portion of the nozzle 10 and is wound around the bobbin 7. Here, the line material A is a copper wire which forms a transformer.

Next, the nozzle rotating mechanism 11 is formed by a belt pulley 11*a*, a belt 11*b*, a rotation driving motor 11*c*, a drive-side pulley 11*d*, a supporting piece lie, and such. The belt pulley 11*a* is on top of the plate 8 and is fixed to the same axle as that of the nozzle guide 9. The drive-side pulley 11*d* is connected to the belt pulley 11*a* via the belt 11*b* and is attached to the axle of the rotation driving motor 11*c*. The supporting piece 11*e* fastens the rotation driving motor 11*c* on to the plate 8. This type of nozzle rotating mechanism 11 rotates the nozzle guide 9 and the nozzle 10 which is inserted in the nozzle guide 9 with the guide hole 9*b* as the center of rotation by the operation of the rotation driving motor 11*c*.

Then, the nozzle guide moving mechanism 12 is formed by a pair of cylinders 12*a*, 12*b* and a movable plate 12*c*. Each of the cylinders 12*a*, 12*b* are fixed on top of the plate 8 so as to have their shafts move in the vertical direction. Both end portions of the movable plate 12*c* are fixed to the top ends of the shafts of the cylinders 12*a*, 12*b*, and the tail portion of the nozzle guide 9 is fixed to the center portion of the movable plate 12*c*. This type of nozzle guide moving mechanism 12 vertically moves the nozzle guide 9 with respect to the nozzle 10 which is fixed to the supporting piece 8*a* by the operation of the cylinders 12*a*, 12*b* (Refer to FIGS. 2A and 2B).

Next, the operation of the winding apparatus formed in this manner will be explained.

When winding the line material A on to the bobbin 7, the first order of operation is the winding of the line material A on to a predetermined pole-shaped terminal 7*c*. In this case, the inclined moving portion 5 is operated and the nozzle guide 9 is positioned parallel to the pole-shaped terminal 7*c*, and the nozzle guide moving mechanism 12 is operated, and the tip surface 9*a* of the nozzle guide 9 and the tip portion 10*a* of the nozzle 10 are approximately coplanar (Refer to FIG. 2B). And then, by the operations of the x-axis moving portion 2 and the y-axis moving portion 3 and the z-axis moving portion 4, the pole-shaped terminal 7*c* is inserted into the guide hole 9*b* of the nozzle guide 9.

Figure 3:
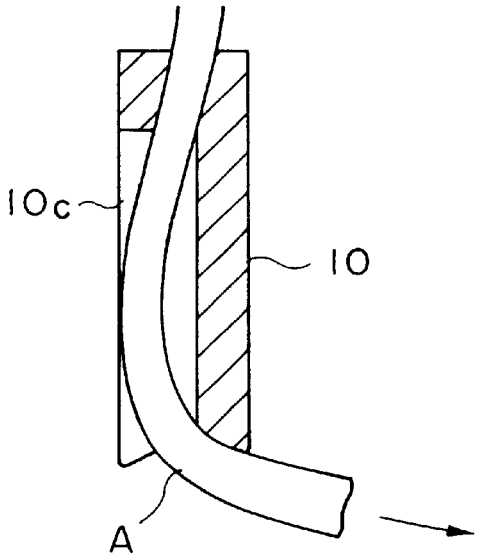
FIG. 3 is a conceptual diagram that illustrates the effect of a preferred embodiment of the present invention.

With respect to this state, by the operation of the nozzle rotating mechanism 1, the nozzle 10 rotates around the periphery of the pole-shaped terminal 7*c* with the guide hole 9*b* as the center of rotation, and the line material A which is pulled out from the tip portion 10*a* of the nozzle 10 is wound around the pole-shaped terminal 7*c*. In this case, since the notch portions 9*e*, 10*c* are formed with the above mentioned dimensions and are formed to be positioned on the opposite side of the guide hole 9*b*, the line material A which is pulled out from the tip portion 10*a* of the nozzle 10 gently bends due to the presence of the notch portions 9*e*, 10*c*, as illustrated in FIG. 3

In other words, since the bending rate at the tip portion 10*a* of the nozzle 10 becomes small, the frictional force which is generated by the sliding movement of the line material A on the tip portion 10*a* is lessened when compared to the case where the notch portions 9*e*, 10*c* do not exist. Accordingly, since the tension of the line material A is reduced, it is possible to prevent such phenomena as the deformation of the nozzle 10. In addition, since the tip of the pole-shaped terminal 7*c* is inserted into the guide hole 9*b* and is supported by the nozzle guide 9, it is possible to unquestionably prevent such phenomena as the bending of the pole-shaped terminal 7*c*.

In this manner, when the winding of the line material A on the tip portion of the pole-shaped terminal 7*c* is completed, the nozzle guide moving mechanism 12 is operated and the nozzle guide 9 is pulled up from the tip portion 10*a* of the nozzle 10, and the tip portion 10*a* of the nozzle 10 is exposed (Refer to FIG. 2A). In this state, since the shape of the tip of the nozzle 10 becomes thin due to the retracting of the nozzle guide 9, it is possible to perform a fine positioning of the tip portion 10*a* of the nozzle 10 with respect to the bobbin 7.

With regard to this state, by the operations of the x-axis moving portion 2 and the y-axis moving portion 3 and the z-axis moving portion 4, the tip portion 10*a* of the nozzle 10 is positioned on the outer periphery of the winding portion 7*a* of the bobbin 7 (on the flange-side which provides the pole-shaped terminals 7*c*). And then, when the bobbin 7 is rotatably driven, the line material A is wound around the winding portion 7*a* a predetermined number of times by the movement of the tip portion 10*a* of the nozzle 10 around the outer periphery of the winding portion 7*a*. When winding, by the operation of the nozzle rotating mechanism 1, the position of the notch portion 10*c* is set and maintained to be on the opposite side of the direction in which the line material A is pulled out.

Accordingly, even in this type of winding of the line material A, the line material A which is pulled out from the tip portion 10*a* of the nozzle 10 is made to bend gently due to the presence of the notch portion 10*c*. Therefore, the frictional force generated by the sliding movement of the line material A against the tip portion 10*a* is lessened, and also the tension of the line material A is reduced. With respect to the winding process, when a fine positioning of the tip portion 10*a* of the nozzle 10 is not necessary due to the shape of the bobbin 7 or the thickness of the line material A or such, the winding is performed with the nozzle guide 9 in the lowered position, thereby increasing the rigidity of the nozzle 10 and preventing the bending of the nozzle 10.

When the winding process of the line material A performed in this manner is completed, the nozzle guide moving mechanism 12 is operated and the nozzle guide 9 is lowered, and further, the x-axis moving portion 2 and the y-axis moving portion 3 and the z-axis moving portion 4 are operated, and the pole-shaped terminal 7*c* is inserted into the guide hole 9*b*. And then, as explained earlier, by the operation of the nozzle rotating mechanism 11, the nozzle 10 revolves around the periphery of the pole-shaped terminal 7*c* and the line material A is wound around the pole-shaped terminal 7*c*. In this manner, the winding of the first coil of the transformer is completed. Hereafter, the winding of the second coil is performed in a similar manner.

According to the above described embodiment, the present invention is effective in the case where the winding line material A is a relatively thick copper wire (thick line). In the case of a thick line, since the contact surface area between the nozzle 10 and the tip portion 10*a* of the nozzle 10 would be large, the frictional force generated when the bending rate increases will also become large. Accordingly, since the tension will also become large, the tension applied to the nozzle 10 and the pole-shaped terminal 7*c* also becomes large. Thus, the nozzle 10 and the pole-shape terminal 7*c* may easily deform. However, by providing the above described notch portion 10*c* on the nozzle 10, the bending rate of the thick line can be reduced, thereby exhibiting effectiveness of the notch portion 10*c*.

In addition, since it is not necessary to employ a mechanism for forcibly pulling out a line material A from the nozzle 10 as is conventionally done, it is possible to tightly wind the line material A on to the pole-shaped terminal 7*c*. Since the dimensions of the notch portion 10*c* is determined in accordance with the type of the line material A, for example, the thickness or the rigidity of the line material A, it is possible to effectively ease the amount of bending of the line material A in accordance with the type of the line material A.

Furthermore, since the terminal winding means supports the nozzle 10, and is formed by a nozzle guide 9 which is formed by a guide hole 9*b* on its tip surface, a nozzle guide moving mechanism 12 which allows the movement of the nozzle guide 9 relative to the tip portion 10*a* of the nozzle 10 and which inserts the pole-shaped terminal 7*c* into the guide hole 9*b*, and a nozzle rotating mechanism 11 which, in the state where the pole-shaped terminal 7*c* is inserted into the guide hole 9*b*, rotates the nozzle 10 around the periphery of the pole-shaped terminal 7*c* with the guide hole 9*b* as the center of rotation, it is possible to prevent the damaging of the pole-shaped terminal 7*c* when winding the line material A around the pole-shaped terminal 7*c*, and it is possible to perform fine positioning of the nozzle 10 with respect to the bobbin 7 by the retracting of the nozzle guide 9 from the tip portion of the nozzle 10 when winding.

Although a winding apparatus which winds a transformer is explained in the above embodiment, the present invention is not limited to such. For example, it is possible to appropriately use the present invention for a winding apparatus which winds strings (textile fibers) or fishing lines as its line material.

What is claimed is:

1. A winding apparatus to wind a line material around a bobbin by rotating said bobbin, said winding apparatus comprising:

a nozzle for delivering said line material from a tip portion, with a notch portion formed from said tip portion along a side surface of said nozzle;

a nozzle rotating mechanism for rotating said nozzle so that said notch portion is set to be on an opposite side of a direction in which said line material is delivered, so as to ease the amount of bending of said line material;

a terminal winding means that inserts a terminal of said bobbin into a guide hole and rotates said nozzle around the periphery of said terminal with said guide hole as the center of rotation, during the winding process of said line material onto said terminal; and an inclined moving portion for tilting said terminal winding means so as to set said nozzle parallel to said terminal of said bobbin.

2. A winding apparatus in accordance with claim 1, in which the dimensions of said notch portion is determined according to the type of said line material.

3. A winding apparatus in accordance with claim 1, in which said terminal winding means further comprises:

a nozzle guide, which maintains said nozzle and which forms a guide hole at the tip surface thereof, a nozzle guide moving mechanism, which moves said nozzle guide relative to the tip portion of said nozzle; and a nozzle rotating mechanism, which with said terminal inserted inside said guide hole, rotates said nozzle around the periphery of said terminal with said guide hole as the center of rotation.

4. A winding apparatus in accordance with claim 3, wherein said nozzle guide has an eccentric hole at said tip surface holding said nozzle in a manner of insertion; and said nozzle guide moving mechanism having means for moving forward said tip surface of said nozzle guide at said tip portion of said nozzle and then inserting said terminal into said guide hole during the winding process of said line material onto said terminal, and retracting said tip surface from said tip portion of said nozzle so as to bare said tip portion during the winding process of said line material onto said bobbin.

5. A winding apparatus to wind a line material around a bobbin by rotating said bobbin, said winding apparatus comprising:

a nozzle guide with a guide hole formed at the tip surface of said nozzle guide to insert a terminal of said bobbin;

a nozzle that is held in a manner of insertion into said nozzle guide and delivers said line material from a tip portion, and with a notch portion formed from said tip portion along a side surface of said nozzle so as to ease the amount of bending of said line material;

a nozzle rotating mechanism, which with said terminal inserted inside said guide hole rotates said nozzle around the periphery of said terminal with said guide hole as the center of rotation; and an inclined moving portion for tilting said terminal winding means so as to set said nozzle parallel to said terminal of said bobbin.

6. A winding apparatus in accordance with claim 5, wherein the dimensions of said notch portion are determined according to the type of said line material.

7. A winding apparatus in accordance with claim 5, wherein said nozzle guide has an eccentric hole at said tip surface holding said nozzle in a manner of insertion, said winding apparatus further comprising a nozzle guide moving mechanism having means for moving forward said tip surface of said nozzle guide at said tip portion of said nozzle and then inserting said terminal into said guide hole during the winding process of said line material onto said terminal, and retracting said tip surface from said tip portion of said nozzle so as to bare said tip portion during the winding process of said line material onto said bobbin.

* * * * *